US007883047B2

(12) United States Patent
Chen

(10) Patent No.: US 7,883,047 B2
(45) Date of Patent: Feb. 8, 2011

(54) TENSION ADJUSTMENT STRUCTURE FOR FABRIC WINDING MACHINE

(75) Inventor: Shih-Chi Chen, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 74 days.

(21) Appl. No.: 12/489,649

(22) Filed: Jun. 23, 2009

(65) Prior Publication Data

US 2010/0320306 A1 Dec. 23, 2010

(51) Int. Cl.
*B65H 23/06* (2006.01)

(52) U.S. Cl. ..... 242/421.8; 242/421.9

(58) Field of Classification Search ..... 242/547, 242/419.4–419.5, 420.1, 421, 421.8–421.9, 242/422.4

See application file for complete search history.

(56) References Cited

U.S. PATENT DOCUMENTS 4,729,519 A * 3/1988 Tafel et al. ..... 242/418.1
4,905,927 A * 3/1990 Lesse ..... 242/421.8
5,417,382 A * 5/1995 Petitjean et al. ..... 242/527
6,431,220 B1 * 8/2002 Nakada et al. ..... 139/311

FOREIGN PATENT DOCUMENTS

| | | |
|---|---|---|
| TW | M243472 | 9/2004 |
| TW | M303921 | 1/2007 |
| TW | I296293 | 5/2008 |

* cited by examiner

*Primary Examiner*—Sang Kim
(74) *Attorney, Agent, or Firm*—Muncy, Geissler, Olds & Lowe, PLLC

(57) ABSTRACT

A tension adjustment structure for fabric winding machine includes a driving mechanism, a roller, a fabric pressing mechanism and an adjustment mechanism. The roller and the driving mechanism have corresponding transmission wheels strode by a belt. The driving mechanism drives the roller to roll up a fabric. The fabric pressing mechanism has an action arm and a fabric pressing bar located on the action arm. The fabric pressing bar has a first position without in contact with the fabric and a second position in contact with the fabric and lifted by the fabric. The adjustment mechanism is butted by the action arm when the fabric pressing bar is at the first position to butt the belt and increase initial rolling force of the roller. The action arm releases the belt while the fabric pressing bar is at the second position so that fabric rolling tightness can be controlled.

14 Claims, 9 Drawing Sheets

TENSION ADJUSTMENT STRUCTURE FOR FABRIC WINDING MACHINE

FIELD OF THE INVENTION

The present invention relates to a tension adjustment structure for fabric winding machine and particularly to a tension adjustment structure adopted for a high-stand high-speed fabric winding machine to control initial fabric winding tension.

BACKGROUND OF THE INVENTION

Finished fabric of a conventional knitting machine generally is rolled up by a fabric winding machine. Reference can be found in R.O.C. patent No. M243472. It discloses an improved fabric conveying roller for a fabric winding machine. The fabric winding machine has two side chests. The two side chests have two tracks located in a middle portion in a diagonal and upward manner to receive two ends of a roller. There are a first fabric conveying axle and a second fabric conveying axle transversely located below the two tracks in a parallel manner. When the fabric winding machine proceeds fabric rolling operation, the first and second fabric conveying axles move the fabric to be rolled up by the roller. During fabric rolling operation, the amount of fabric on the roller gradually increases, the roller moves the fabric upwards along the tracks. The fabric winding machine thus constructed has drawbacks in practice, notably:

1. The entire batch of the fabric rolled on the roller presses downwards on the first and second fabric conveying axles. When the amount of the fabric rolled on the roller increases, the fabric is heavier and results in a greater downward pressure on the first and second fabric conveying axles. The fabric becomes tighter. Hence varying fabric tightness is formed.

2. The roller is merely wedged in the tracks with a less desirable coupling effect. The roller could be thrown out of the machine chassis during fabric winding operation and cause hazards.

3. It provides a smaller fabric holding capacity, about 20 kgs. Fabric dying and treatment are more troublesome, and a greater amount of wastes are produced.

To remedy the aforesaid disadvantages, other improvements have been proposed, such as R.O.C. patent No. M303921 and I296293 granted to the Applicant. These two patents propose a fabric winding machine with side chests at two sides, a fabric winding means and a fabric conveying means interposed between the two side chests, and a driving means to drive the fabric winding means and fabric conveying means through a belt and pulleys. The fabric conveying means has a rack arm and a fabric roll-over roller located on the rack arm. During fabric winding, the amount of fabric rolled on the roller of the fabric winding means gradually increases to butt the fabric roll-over roller and generate friction to drive the roller to take up the fabric. Hence the fabric roll-over roller keeps pressing on the fabric with the entire weight without forming a tighter fabric tension. However, they still leave a lot to be desired, such as:

1. At initial fabric winding, in order to ensure that the roller can roll the fabric tightly, the belt and pulleys that drive the roller have to be formed in a tighter condition so that the roller has a greater rolling force to roll the fabric. The belt wears off easily under the tighter condition for a prolonged period of time and results in a shorter life span. Hence the belt has to be displaced frequently. Repair and maintenance cost and time are higher. It is not economic effect.

2. As the belt easily wears off at the tighter condition, friction between the belt and pulleys diminishes and results in slipping. This causes insufficient initial fabric rolling force and too loose of fabric on the roller. The rolled fabric tends to skew at high speed rotation of the fabric winding machine. When the amount of rolling fabric increases and fabric skews to one side of the roller, during operation of the fabric winding machine, unbalance occurs and operation of the fabric winding machine could be interrupted.

SUMMARY OF THE INVENTION

The primary object of the present invention is to solve the aforesaid disadvantages by providing a sufficient fabric rolling force for the roller at the initial fabric rolling stage so that the fabric can be rolled tighter on the roller at the initial rolling stage without skewing.

To achieve the foregoing object, the present invention provides a tension adjustment structure for fabric winding machines. It includes a driving mechanism, a roller, a fabric pressing mechanism and an adjustment mechanism that are located on a fabric winding machine. The roller is coupled with the driving mechanism through a first transmission unit. The first transmission unit has two transmission wheels located respectively on the driving mechanism and the roller and a belt striding over the two first transmission wheels so that the driving mechanism can drive the roller to roll up fabric through the two transmission wheels and the belt. The fabric pressing mechanism has an action arm located on the fabric winding machine and a fabric pressing bar located on the action arm. The fabric pressing bar has a first position without in contact with the fabric and a second position in contact with the fabric and lifted by the fabric. The adjustment mechanism has a brake member in contact with the action arm, a pressing member corresponding to the belt and a linkage unit located between the brake member and the pressing member. When the fabric pressing bar is at the first position, the brake member is butted by the action arm, the pressing member butts the belt through the linkage unit to increase fabric rolling tension. When the fabric pressing bar is at the second position and driven by the action arm, the pressing member is released from the belt through the linkage unit. Thus wearing of the belt is reduced and the life span thereof is increased.

As a result, the fabric can be rolled steadily without skewing and the rolled up fabric has a consistent tightness, and the fabric rolling quality is higher than that formed by the conventional techniques.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
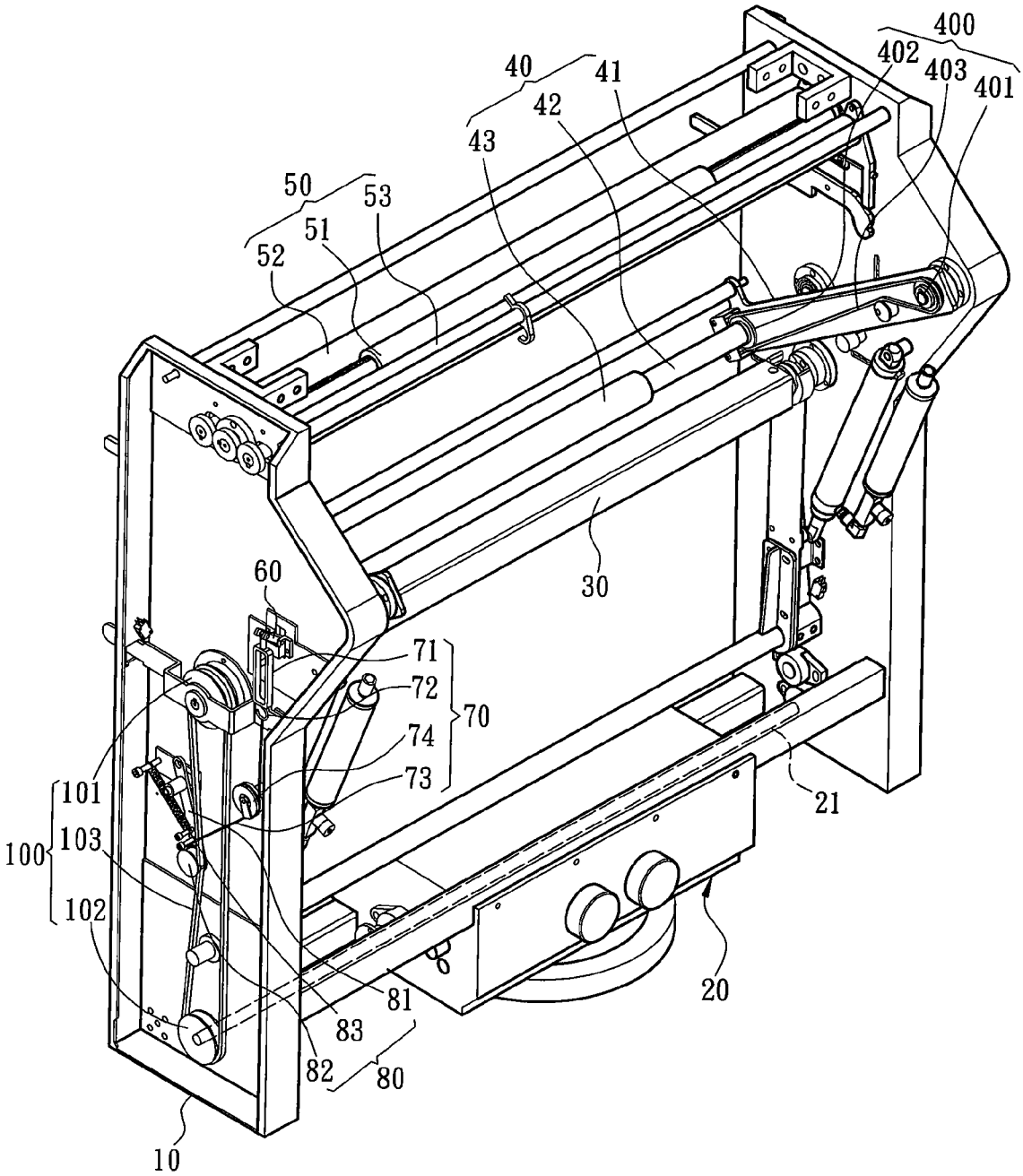
FIG. 1 is a perspective view of the invention.
Figure 2:
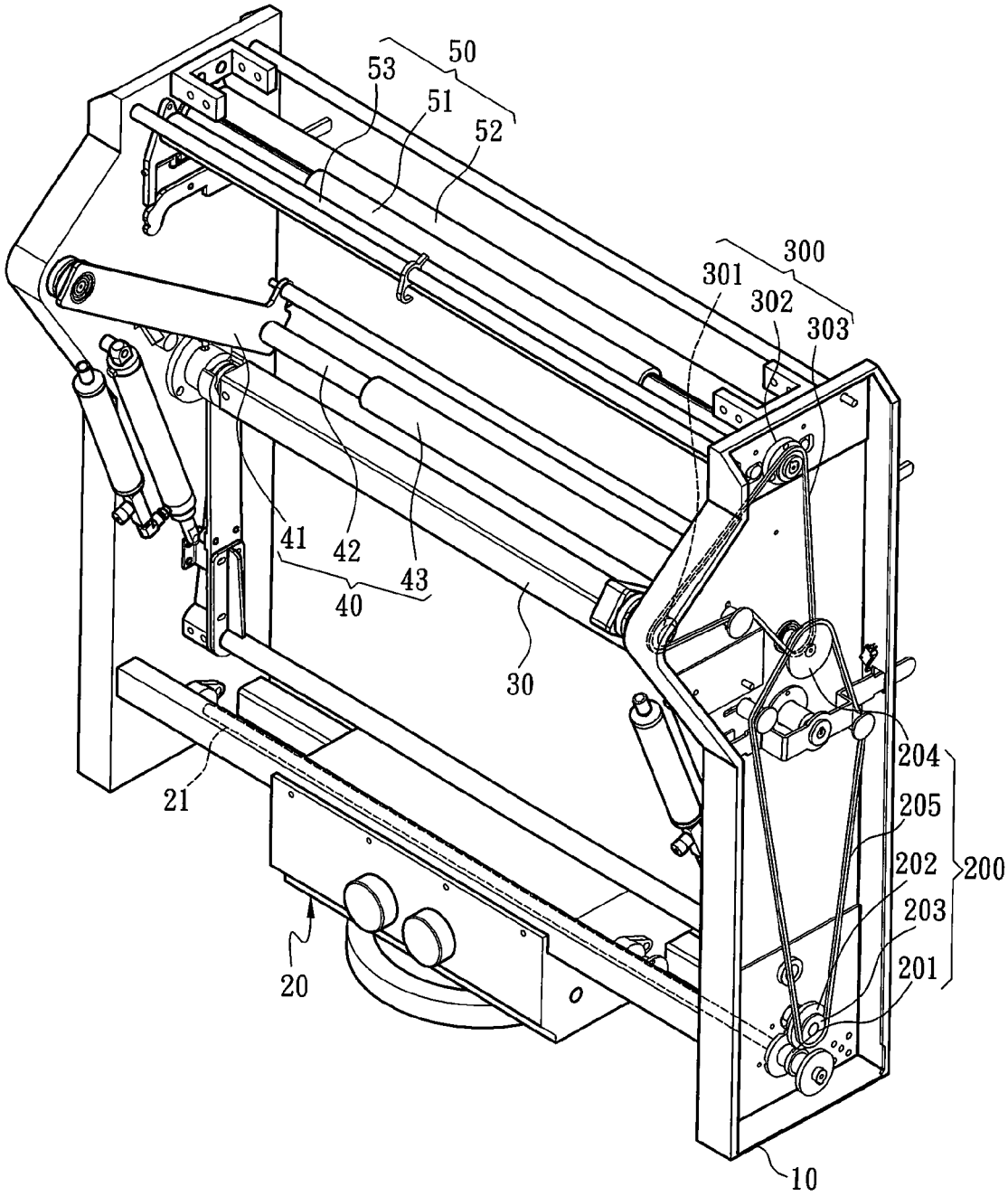
FIG. 2 is another perspective view of the invention.

Please refer to FIGS. 1 and 2, the present invention provides a tension adjustment structure for a fabric winding machine. The fabric winding machine includes two side chests 10, a driving mechanism 20, a roller 30, a fabric pressing mechanism 40 and a fabric conveying mechanism 50 that are located between the two side chests 10 and disposed upwards in this order. There is also an adjustment mechanism in the side chests 10 between the driving mechanism 20 and the fabric pressing mechanism 40. When the invention is in use for rolling fabric, the adjustment mechanism is driven by the fabric pressing mechanism 40 to adjust the fabric rolling tension of the roller 30. The driving mechanism 20 is located between the two side chests 10 close to the bottom, and has an axle 21 extended outwards from inside. The axle 21 has two ends running through the two side chests 10. The roller 30 is located between the two side chests 10 close to the center, and is coupled with the driving mechanism 20 through a first transmission unit 100 located in one side chest 10. The first transmission unit 100 has two first transmission wheels 101 and 102 that are located respectively on the roller 30 and the axle 21, and a first belt 103 striding over the two first transmission wheels 101 and 102 to drive the roller 30 to roll up fabric.

The fabric pressing mechanism 40 includes two action arms 41 pivotally located in the two side chests 10 and a fabric pressing bar 42 located between the two action arms 41. The fabric pressing bar 42 has a friction portion 43 to press the fabric. The fabric pressing bar 42 is driven by the driving mechanism 20 through a second transmission unit 200, a third transmission unit 300 and a fourth transmission unit 400. The fabric conveying mechanism 50 is located between the top of the two side chests 10, and includes a main rolling bar 51 and two secondary rolling bars 52 and 53 that are driven by the driving mechanism 20 through the second and third transmission units 200 and 300. The second and third transmission units 200 and 300 are located in another side chest 10 opposing to the first transmission unit 100. The fourth transmission unit 400 is located on the action arm 41 abutting the side chest 10. In an embodiment of the invention, the second transmission unit 200 has four second transmission wheels 201, 202, 203 and 204 and a second belt 205. One second transmission wheel 201 is located at another end of the axle 21. Another second transmission wheel 202 is pivoted on one side of the axle 21 and engaged with the second transmission wheel 201. Yet another second transmission wheel 203 is coaxially mounted with the second transmission wheel 202. Still another second transmission wheel 204 is pivotally located in the side chest 10 above the roller 30. The second belt 205 winds around the second transmission wheels 203 and 204. The third transmission unit 300 includes two third transmission wheels 301 and 302, and a third belt 303. One third transmission wheel 301 is pivoted on one end of the action arm 41. The other third transmission wheel 302 is pivoted on one end of the main rolling bar 51. The third belt 303 winds around the third transmission wheels 301 and 302 and the second transmission wheel 204. By means of the construction set forth above, the third transmission unit 300 can be driven by the second transmission unit 200. The fourth transmission unit 400 includes two fourth transmission wheels 401 and 402 and a fourth belt 403. One fourth transmission wheel 401 is pivoted on one end of the action arm 41 corresponding to the third transmission wheel 301. The other fourth transmission wheel 402 is pivoted on one end of the action arm 41 corresponding to the fabric pressing bar 42. The fourth belt 403 winds around the fourth transmission wheels 401 and 402 so that the fourth transmission unit 400 can be driven by the third transmission unit 300 to drive rotation of the fabric pressing bar 42.

Figure 3:
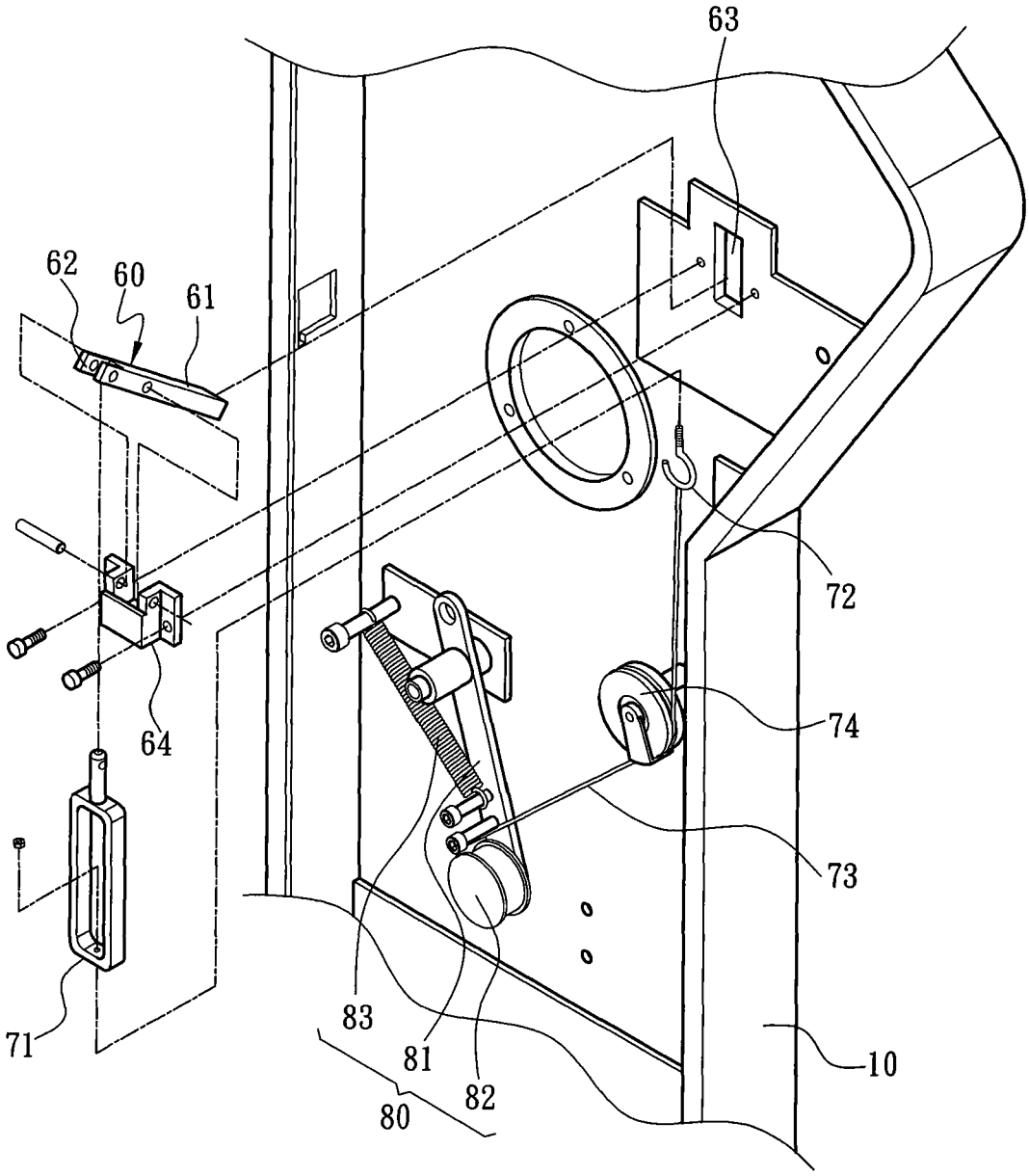
FIG. 3 is a fragmentary exploded view of the invention.

Also referring to FIG. 3, the adjustment mechanism is located in the side chest 10 where the first transmission unit 100 is held. It includes a brake member 60 pivotally located in the side chest 10 corresponding to the action arm 41, a pressing member 80 corresponding to the first belt 103 and a linkage unit 70 located between the brake member 60 and the pressing member 80, and to connect the brake member 60 and the pressing member 80. The side chest 10 has a mounting opening 63 to install the brake member 60 and a mounting rack 64 outside the mounting opening 63 to allow the brake member 60 to be pivoted thereon. The brake member 60 has an action end 61 at one end corresponding to the action arm 41 and a fastening end 62 at the other end fastened to the linkage unit 70. The pressing member 80 includes a movable lever 81 pivotally located in the side chest 10 and a pressing wheel 82 located on the movable lever 81 corresponding to the first belt 103, and an elastic element 83 with two ends coupling respectively with the side chest 10 and the movable lever 81. The linkage unit 70 includes a linkage element 71 pivoted on the brake member 60 and a pulling cord 73. The pulling cord 73 has two ends fastened to the linkage element 71 and the movable lever 81. The linkage element 71 further has a linking hook 72 with one end hooked to the pulling cord 73 and the other end screwing with the linkage element 71 to adjust the height of the linking hook 72 to control the tension of the pulling cord 73. The fabric winding machine also has an ancillary wheel 74 to stride over the pulling cord 73 so that the pulling direction of the pulling cord 73 can be changed to pull the pressing member 80.

Figure 4A:
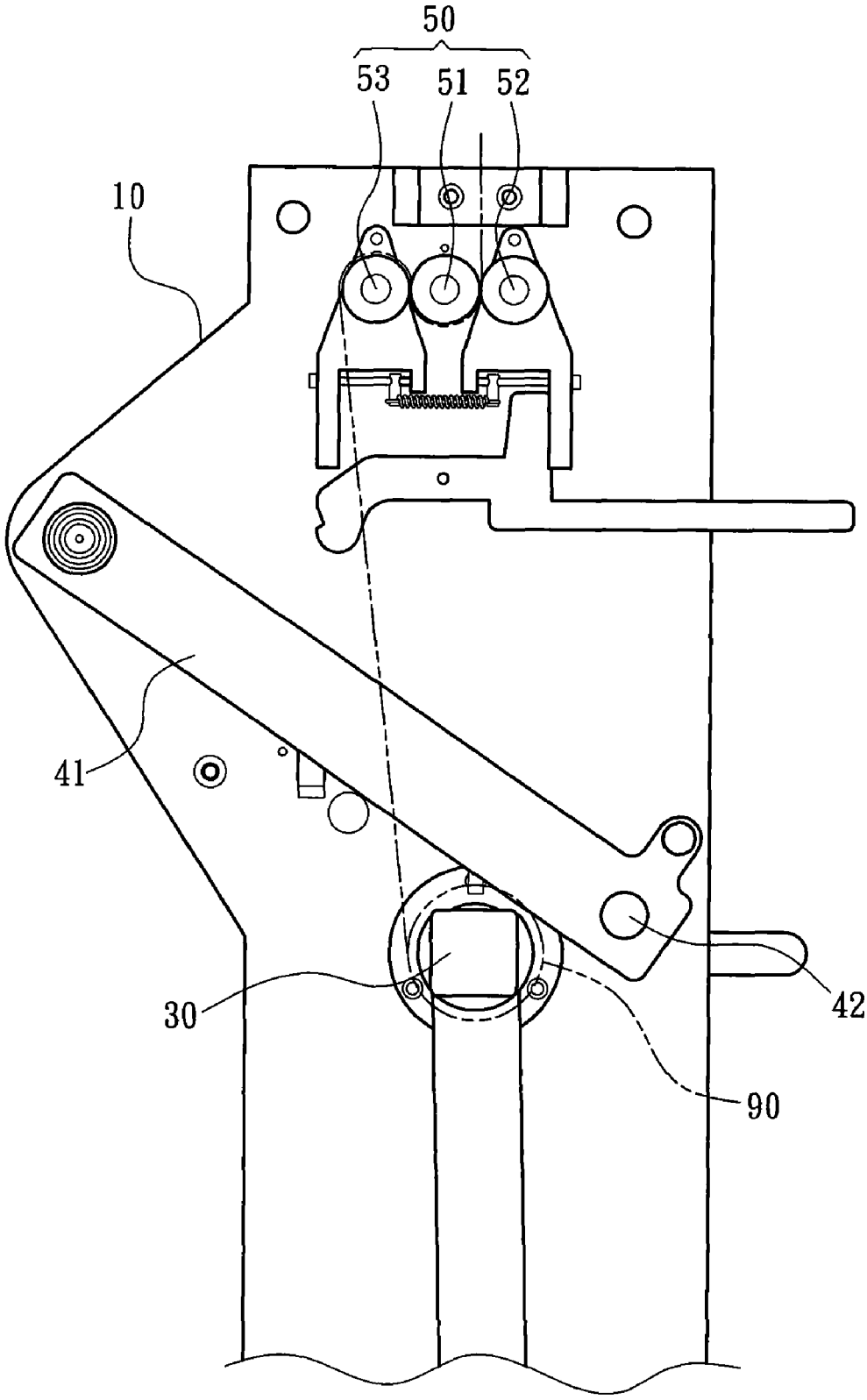
FIGS. 4A and 4B are schematic views of the invention in operating condition-1.
Figure 5A:
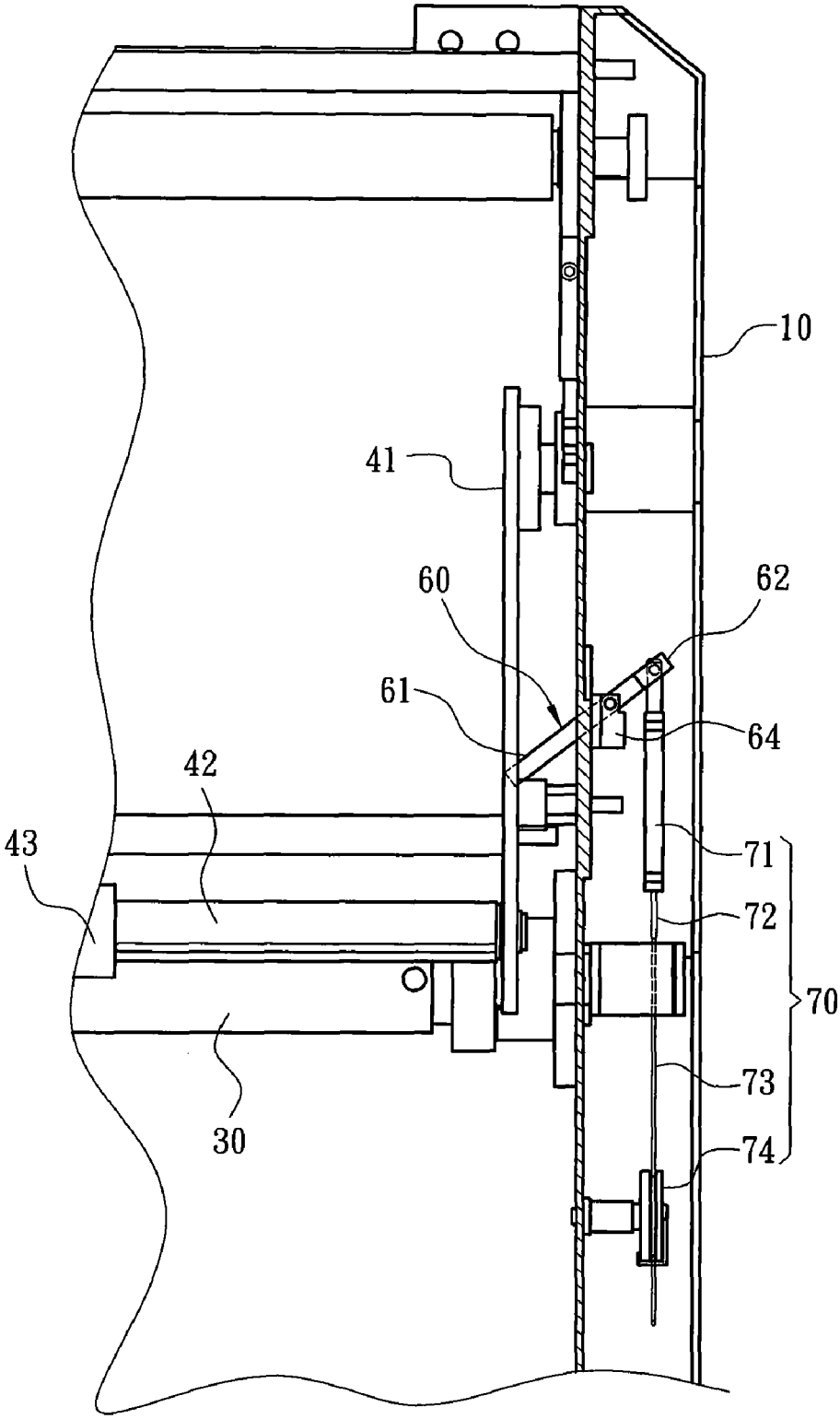
FIGS. 5A and 5B are schematic views of the invention in operating condition-2.
Figure 6A:
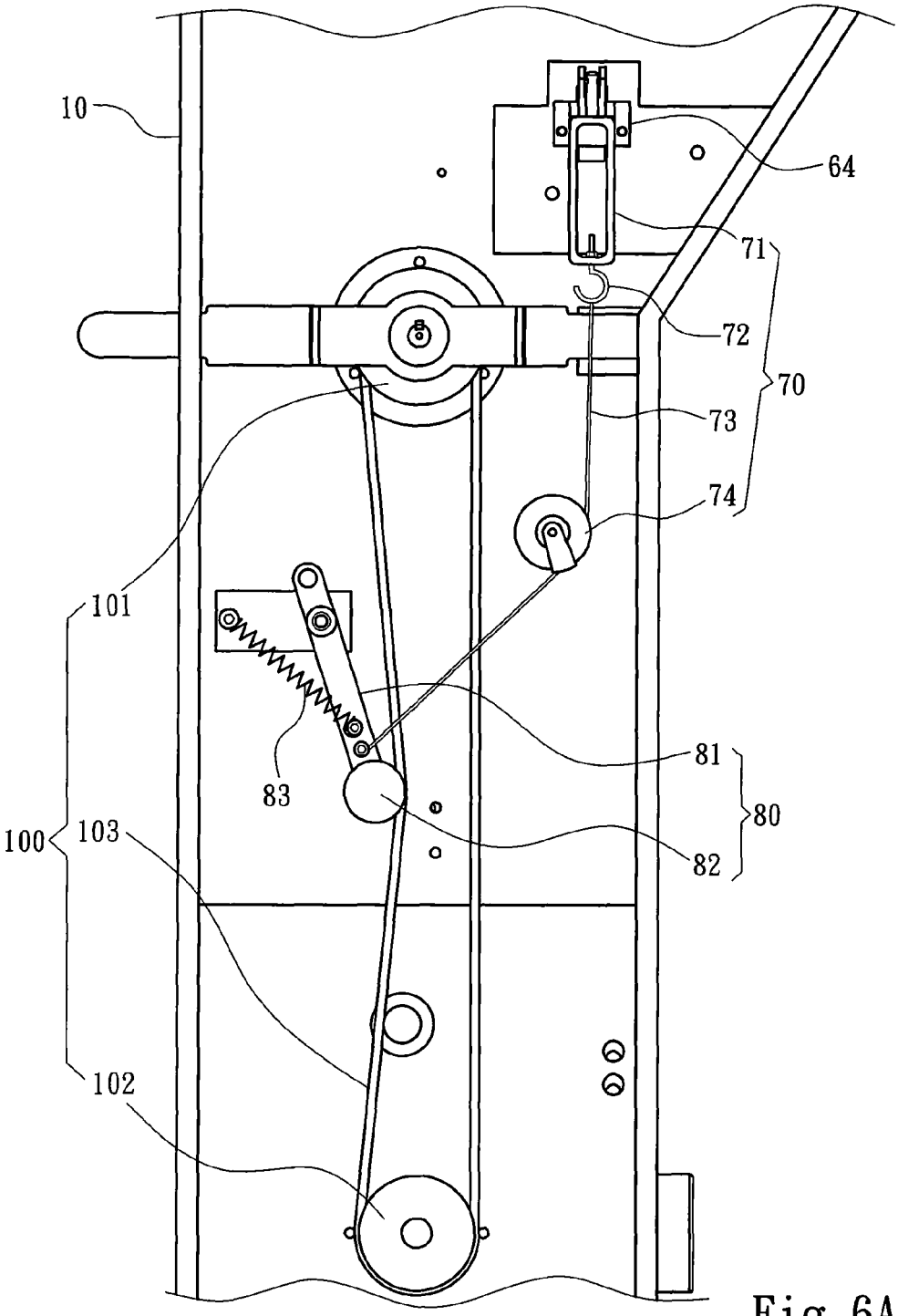
FIGS. 6A and 6B are schematic views of the invention in operating condition-3.

When in use, the fabric 90 is conveyed through the main rolling bar 51 and the secondary rolling bars 52 and 53 of the fabric conveying mechanism 50 to the roller 30. At the initial fabric rolling stage, the fabric pressing bar 42 is at the first position without in contact the fabric 90 (referring to FIG. 4A), and the brake member 60 is pressed by the action arm 41 due to the fabric pressing bar 42 at the first position such that the action end 61 is pushed downwards and the fastening end 62 is lifted upwards (referring to FIG. 5A). Through the linkage element 71 and the movable lever 81 pulled by the pulling cord 73 and the elastic element 83, the pressing wheel 82 is moved to butt the first belt 103 (referring to FIG. 6A); hence the first belt 103 tightly presses the first transmission wheels 101 and 102 without slipping. As a result, the rotation speed of the roller 30 can be increased and fabric tension also can be enhanced, and the fabric 90 can be steadily rolled up on the roller 30.

Figure 4B:
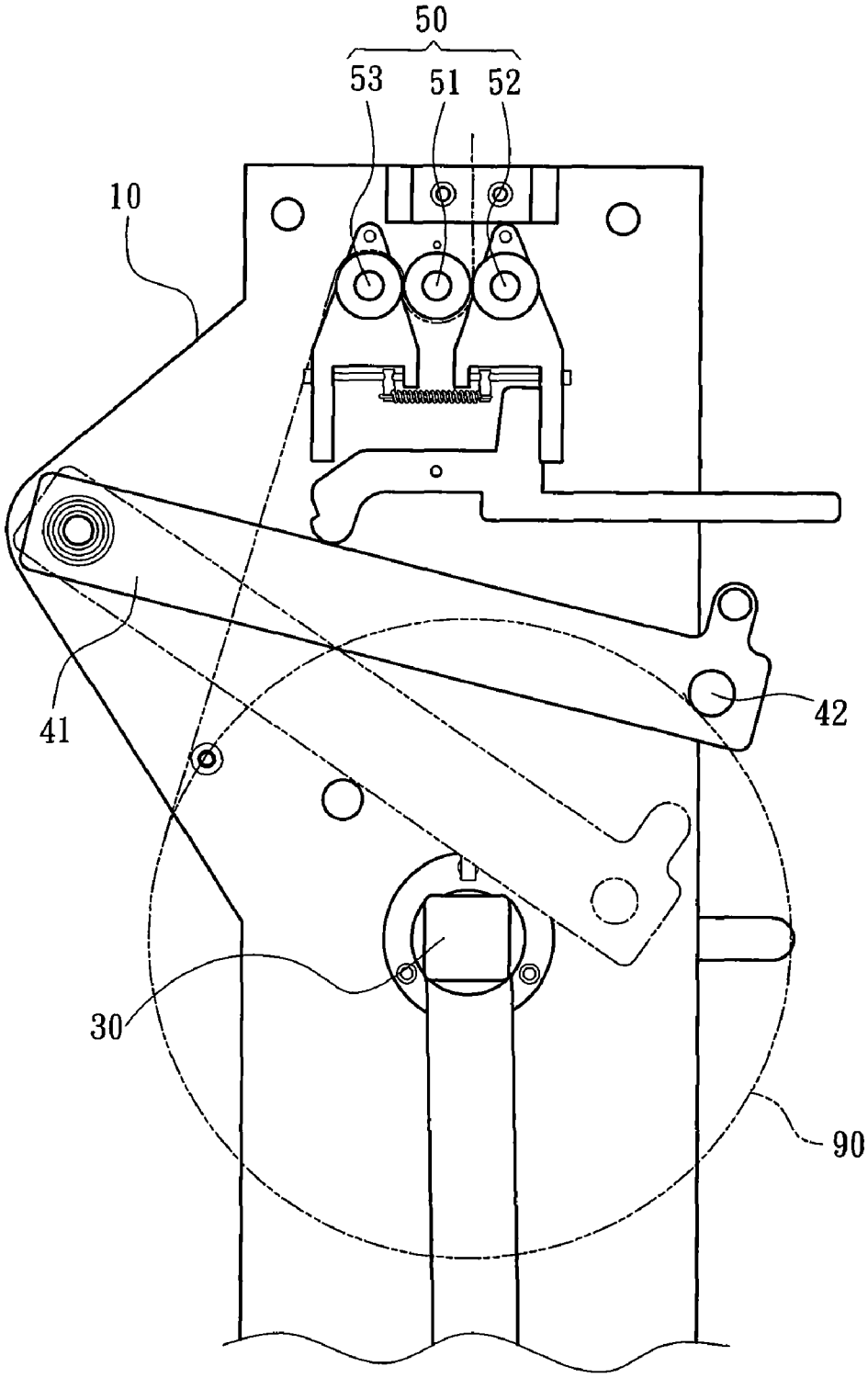
Figure 5B:
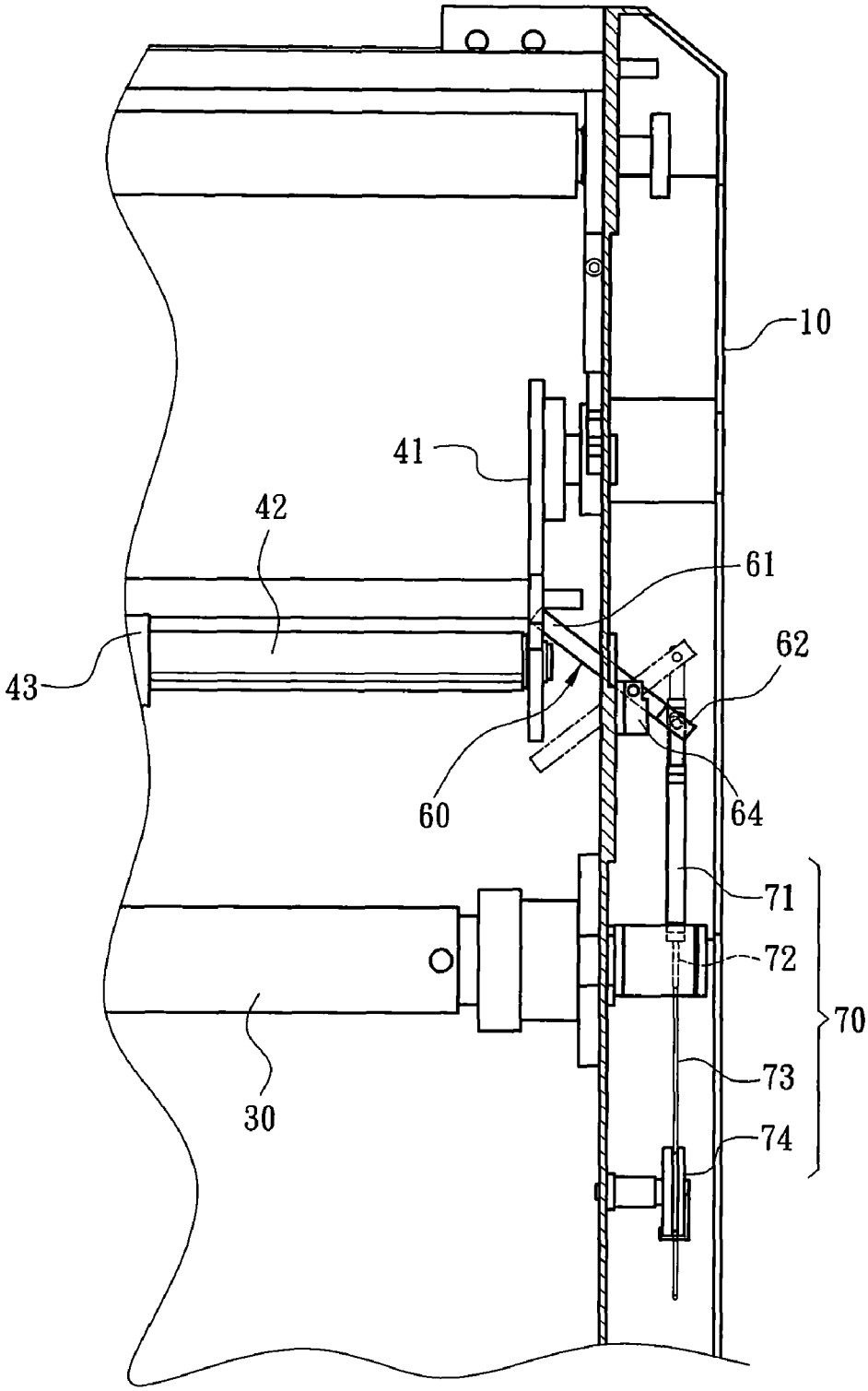
Figure 6B:
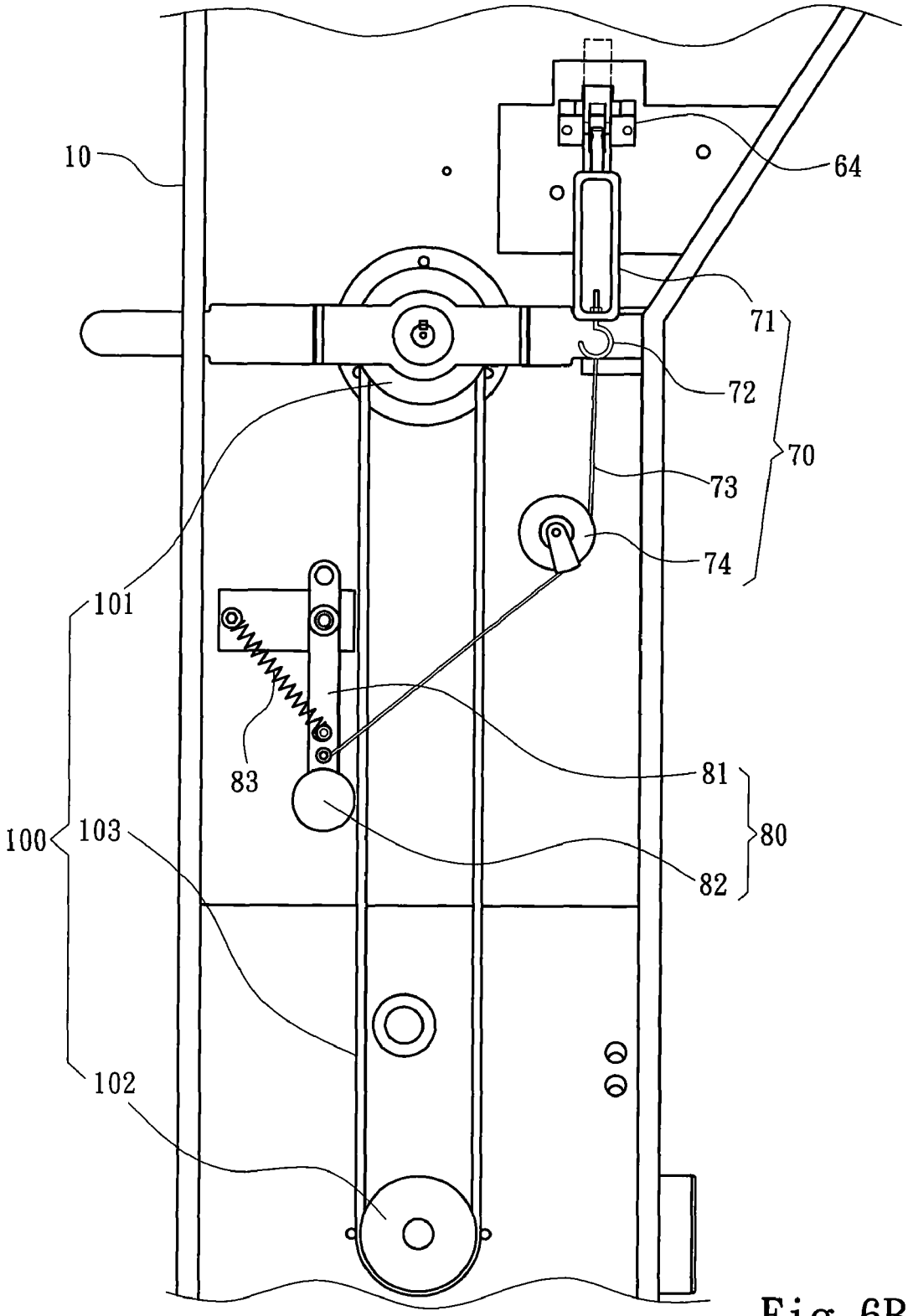

As the fabric rolling operation continues, the amount of the fabric 90 rolled on the roller 30 increases, the fabric pressing bar 42 is in contact with the fabric 90 and lifted to the second position (referring to FIG. 4B), and the action arm 41 is moved upwards to lift the action end 61 and lower the fastening end 62 of the brake member 60 (referring to FIG. 5B); the movable lever 81 is released loosely through the linkage element 71 and the pulling cord 73, and the elastic element 83 provides an elastic force to pull the movable lever 81 back to move the pressing wheel 82 and release the first belt 103 (referring to FIG. 6B). Hence if the roller 30 and the fabric pressing bar 42 rotate at different speeds, slipping occurs between the first belt 103 and the first transmission wheels 101 and 102. Rolling up of the fabric 90 mainly is controlled by the fabric pressing bar 42, thus rolling tightness of the fabric 90 can be maintained consistent.

As a conclusion, adopted the invention, at the initial fabric rolling stage, the brake member 60 is butted by the action arm 41 at the first position, the linkage unit 70 is pulled so that the pressing member 80 butts the first belt 103 of the first transmission unit 100, therefore, the initial rolling force of the roller 30 is increased to steadily roll up the fabric 90 on the roller 30 at the initial stage. The fabric 90 also can be rolled on the roller 30 without skewing during the rolling operation of the fabric winding machine. Moreover, when the fabric 90 has been rolled up at a selected amount, the action arm 41 is lifted by the fabric 90 to the second position, and the brake member 60 is moved by the action arm 41 to release the pressing member 80 through the linkage unit 70 from the first belt 103. Hence wearing of the belt can be reduced and the life span of the belt can be increased. Meanwhile, the roller 30 is released, and the fabric 90 is controlled mainly by the fabric pressing bar 42 while the roller 30 provides ancillary control. As a result, the rolled up fabric 90 has consistent tightness and the quality of the rolled up fabric is higher. It provides a significant improvement over the conventional techniques.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A tension adjustment structure for a fabric winding machine driven by a driving mechanism to roll up a fabric and adjust the tension of the rolling fabric, comprising:

a roller pivotally located on the fabric winding machine and coupled with the driving mechanism through a first transmission unit, the first transmission unit having two transmission wheels located respectively on the driving mechanism and the roller and a belt striding over the two transmission wheels to drive the roller to roll up the fabric;

a fabric pressing mechanism having an action arm on the fabric winding machine and a fabric pressing bar located on the action arm, the fabric pressing bar having a first position not in contact with the fabric and a second position in contact with the fabric to be lifted upwards; and an adjustment mechanism including a brake member being in contact with the action arm, a pressing member corresponding to the belt and a linkage unit located between the brake member and the pressing member, the brake member being butted by the action arm while the fabric pressing bar is at the first position and the linkage unit driving the pressing member to butt the belt to increase the rolling tension; the fabric pressing bar being moved by the action arm at the second position to release the pressing member from the belt through the linkage unit.

2. The tension adjustment structure of claim 1, wherein the brake member is pivoted on the fabric winding machine and has an action end at one end corresponding to the action arm and a fastening end at the other end to fasten to the linkage unit.

3. The tension adjustment structure of claim 2, wherein the linkage unit includes a linkage element pivoted on the brake member and a pulling cord which has two ends fastened respectively to the linkage element and the pressing member.

4. The tension adjustment structure of claim 3, wherein the linkage element has a linking hook which has one end hooked the pulling cord and the other end screwed with the linkage element to adjust tension of the pulling cord.

5. The tension adjustment structure of claim 3, wherein the fabric winding machine has an ancillary wheel strode by the pulling cord.

6. The tension adjustment structure of claim 1, wherein the fabric winding machine has a mounting opening to install the brake member and a mounting rack on the mounting opening to pivotally couple with the brake member.

7. The tension adjustment structure of claim 1, wherein the pressing member has a movable lever pivoted on the fabric winding machine and a pressing wheel located on the movable lever corresponding to the belt.

8. The tension adjustment structure of claim 7, wherein the fabric winding machine has an elastic element which has two ends connected respectively to the fabric winding machine and the movable lever.

9. The tension adjustment structure of claim 7, wherein the linkage unit has a linkage element pivoted on the brake member and a pulling cord which has two ends fastened respectively to the linkage element and the pressing member.

10. The tension adjustment structure of claim 9, wherein the linkage element has a linking hook which has one end hooked the pulling cord and the other end screwed with the linkage element to adjust tension of the pulling cord.

11. The tension adjustment structure of claim 9, wherein the fabric winding machine has an ancillary wheel strode by the pulling cord.

12. The tension adjustment structure of claim 1, wherein the linkage unit has a linkage element pivoted on the brake member and a pulling cord which has two ends fastened respectively to the linkage element and the pressing member.

13. The tension adjustment structure of claim 12, wherein the linkage element has a linking hook which has one end hooked the pulling cord and the other end screwed with the linkage element to adjust tension of the pulling cord.

14. The tension adjustment structure of claim 12, wherein the fabric winding machine has an ancillary wheel strode by the pulling cord.

* * * * *